US009744803B2

(12) United States Patent
Walant

(10) Patent No.: US 9,744,803 B2
(45) Date of Patent: Aug. 29, 2017

(54) COMMUNICATION OBJECT HAVING VISIBLE IMAGES AND OBSCURED PORTIONS FOR ILLUMINATED VIEWING, AND METHOD OF MAKING

(71) Applicant: Anna Walant, Ridgefield, CT (US)

(72) Inventor: Anna Walant, Ridgefield, CT (US)

( * ) Notice: Subject to any disclaimer, the term of this patent is extended or adjusted under 35 U.S.C. 154(b) by 221 days.

(21) Appl. No.: 14/709,471

(22) Filed: May 11, 2015

(65) Prior Publication Data

US 2015/0321506 A1 Nov. 12, 2015

Related U.S. Application Data

(60) Provisional application No. 61/992,215, filed on May 12, 2014.

(51) Int. Cl.

| | |
|---|---|
| ***B44F 1/06*** | (2006.01) |
| ***B44C 1/00*** | (2006.01) |
| ***B44F 1/10*** | (2006.01) |

(52) U.S. Cl.

CPC ..... *B44F 1/06* (2013.01); *B44C 1/005* (2013.01); *B44F 1/10* (2013.01)

(58) Field of Classification Search

CPC ... B44F 1/06; B44F 1/10; B44C 1/005; B44C 1/00; F21V 33/00; F21V 33/0032; G09F 13/00; G09F 13/06; G09F 13/12

See application file for complete search history.

(56) References Cited

U.S. PATENT DOCUMENTS

| | | | | |
|---|---|---|---|---|
| 1,028,921 A | | 6/1912 | Wagner | |
| 1,745,407 A | | 2/1930 | Colberg | |
| 1,972,123 A | | 9/1934 | Zimmerman | |
| 2,548,043 A | | 4/1951 | Muhlhauser | |
| 3,401,596 A | | 9/1968 | Hirsch | |
| 4,176,473 A | | 12/1979 | Rae | |
| 4,972,305 A | | 11/1990 | Blackburn | |
| 5,301,982 A | * | 4/1994 | Brotz | B41M 3/06 283/83 |
| 5,597,183 A | * | 1/1997 | Johnson | B42D 3/123 281/38 |

(Continued)

OTHER PUBLICATIONS

Heather Zschock, Whoo's There?: A Bedtime Shadow Book, http://www.amazon.com/Whoos-There-Bedtime-Shadow-Activity/dp/1593599048, 2005.

*Primary Examiner* — Bao Q Truong
(74) *Attorney, Agent, or Firm* — Patentec

(57) ABSTRACT

A novelty communication object, such as a sign or printed object (book, brochure, greeting card or the like), and method of making, wherein at least one page, surface or sheet of the object has not only directly visible images, but also a plurality of cut-outs or other portions at least partially transparent or optically reactive to light, which can become visible when a user shines an illumination source such as a flashlight at the page and projects an image of the transparent or optically reactive portions onto a neighboring wall or other surface, or backlights the transparent or optically reactive portions for direct viewing. The plurality of transparent or optically reactive areas are preferably selected so that the illuminated image has a different visual appearance than the directly visible image, thereby enhancing the overall narrative content of the communication object.

23 Claims, 1 Drawing Sheet

(56) References Cited

U.S. PATENT DOCUMENTS

| | | | | |
|---|---|---|---|---|
| 6,206,524 | B1 | 3/2001 | Jacob | |
| 6,502,339 | B1 | 1/2003 | Shapiro | |
| 6,558,022 | B2 | 5/2003 | Kawahara | |
| 6,805,459 | B1 | 10/2004 | Prescott et al. | |
| 7,147,345 | B1 | 12/2006 | Toney, Jr. | |
| 7,832,917 | B2 * | 11/2010 | Chien | F21S 8/035 362/641 |
| 2003/0099104 | A1 | 5/2003 | Hou | |
| 2009/0255156 | A1 * | 10/2009 | Lai | G09F 13/06 40/442 |
| 2013/0258678 | A1 * | 10/2013 | Nichols | F21V 11/16 362/351 |
| 2014/0355249 | A1 * | 12/2014 | Yu | G09F 13/06 362/97.1 |

* cited by examiner

COMMUNICATION OBJECT HAVING VISIBLE IMAGES AND OBSCURED PORTIONS FOR ILLUMINATED VIEWING, AND METHOD OF MAKING

CROSS REFERENCE TO RELATED APPLICATIONS

This application claims benefit of U.S. Provisional Patent Application 61/992215 filed May 12, 2014, the entire content and substance of which is also incorporated herein by reference.

TECHNICAL FIELD OF THE INVENTION

This invention relates to the field of communication objects such as signs and printed objects, and in a particular embodiment, is directed towards novelty books for children and other readers to enhance their reading experience.

BACKGROUND OF THE INVENTION

Communication objects such as advertising signs, printed brochures, greeting cards, and books are well-known. One important goal of such objects is to provide interest to the reader, so as to engage the reader and draw the reader into the narrative of the communication. Accordingly, numerous prior art methods have been devised towards this goal, including pop-ups, cut-outs, unusual textures, electronic audio and visual effects, and other methods. Especially in the field of children's books, there is strong interest in keeping children engaged in the narrative, and therefore interactive techniques such as electronic buttons that can be pressed, windows that can be opened, etc. are known to be particularly effective and popular in the prior art.

Of special interest to the present invention, a series of books known as "bedtime shadow books" feature transparent pages which include printed opaque images designed in such a manner that a user may shine light from a flashlight through the page and project a silhouette of the opaque areas onto a nearby wall. For these books, the silhouette image that appears on the wall is directly correlated with the shapes of the opaque areas in the book.

SUMMARY OF THE INVENTION

The present invention comprises a novelty communication object, such as a sign or printed object (book, brochure, greeting card or the like), and method of making, wherein at least one page, surface or sheet of the object has not only directly visible images, but also a plurality of cut-outs or other portions at least partially transparent or optically reactive to light, which can become visible when a user shines an illumination source such as a flashlight through the page and projects an image of the transparent or optically reactive portions onto a neighboring wall or other surface, or backlights the transparent or optically reactive portions for direct viewing. The plurality of transparent or optically reactive areas are preferably selected so that the illuminated image has a different visual appearance than the directly visible image, thereby enhancing the overall narrative content of the communication object.

DETAILED DESCRIPTION

Figure 1:
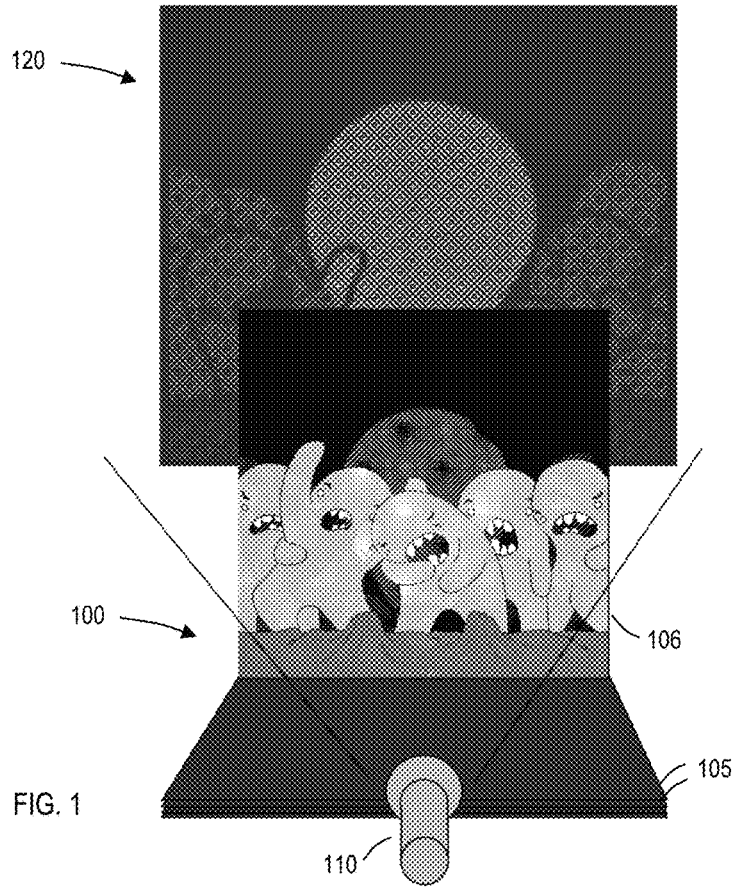
FIG. 1 shows a communication object according to the present invention, in the preferred embodiment of a children's book, and its method of use.
Figure 2:
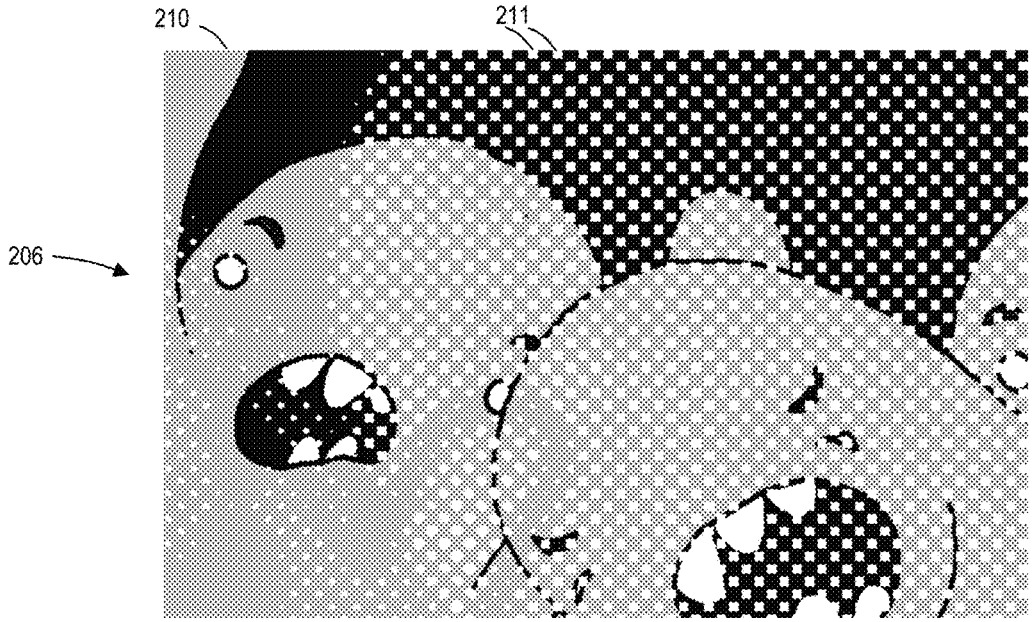
FIG. 2 is an enlarged close-up view of a page of the children's book of FIG. 1 showing opaque and transparent portions.

FIG. 1 shows a preferred embodiment of the present invention, comprising a book 100 having one or more pages 105, spiral or otherwise bound in such a fashion that a single page 106 may be extended away from the other pages. The sequence of pages may tell a story. At least one such page, shown in further detail in FIG. 2, has enlarged portion 206 which includes visible indicia such as pictures, images, and/or text 210, printed as opaque images, and also includes obscured indicia in the form of tiny cutouts or otherwise at least partially transparent, reflective, or otherwise optically reactive portions 211 whose content may become visible when an additional illumination source such as flashlight 110 in FIG. 1 is aimed at the page, thereby enabling light to pass through the tiny transparent portions and project an image 120 as shown in FIG. 1 onto a neighboring wall or other surface, or become visible by backlighting. The narrative content of the illuminated image is preferably distinct from the directly visable image, but may be related to and selected to enhance the narrative content of the directly visable image appearing on the same page. The intent is to present a story or other content that can only fully be appreciated by incorporating the use of a light source, thereby increasing the wonder and excitement of reading the book.

The optically reactive portions may be arrays of small dots or other shapes (generically called herein "dots"), that are cut or otherwise created in a pattern or sequence that collectively combine to make at least one image, in the manner of a halftone. The pattern may be chosen to be the negative of a desired image, in the sense that the brightest portions of the desired image may have the highest density or total area of transparent dots and the darkest areas the least. While the preferred embodiment has the dots comprising tiny holes that are embossed or cut using a laser or other energy beam through an opaque sheet, it is also possible to practice the present invention by printing opaque images comprising tiny voids onto a transparent sheet, such that the transparent dots are formed by the tiny voids in the opaque image, and may include any pigmentation within the transparent substrate through which the illumination may pass. Thus, any process that produces tiny transparent, reflective, or otherwise optically reactive dots in an otherwise opaque sheet is considered to come within the scope of the present invention. It is also possible to vary the size, shape, relative positioning (e.g., uniform array vs. error diffusion), etc. of the dots without affecting the spirit of the invention. It is also possible to use larger transparent portions (i.e., wherein the dots are so large that they merge into complete transparent portions) in areas of the image where the illumination is to be brightest, and complete absence of dots in shadow areas where the illumination is least. The dots may comprise a partially transparent or translucent membrane upon which is fabricated an opaque image, and may further contain color pigmentation that is printed, embedded, photographically processed or otherwise incorporated. The dots may comprise holographic elements that can generate a 2D or 3D image when illuminated with a suitable light source such as a laser. The illuminated image may comprise only large transparent regions and complete opaque regions. The transparent portions may be superimposed on the areas having the visible opaque image, or may be located at a different portion of the page.

In reading the book, as the user shines a light, i.e. a flashlight, LED, laser or other illumination source such as the beam from a smart phone, at each page, they may view two images at once—the original, visible opaque image printed on the page, and the contrasting, unexpected image generated by illumination passing through the transparent portions. Instead of being held by the user, the illumination source may be incorporated into a portion of the book, such as a back cover, and arranged so that the pages will align with the illumination source as the user moves each page into position to view, or as the illumination source and/or user are moved relative to each other or to the page. The illumination source may be attached by a tether, for example a goose-neck cable, to be manipulated by the user for proper projection or viewing, or the source may be fixed, and the pages disposed offset from the source, or having large cutouts on each page so that the illumination can pass to the currently exposed page. The illuminated image may become visible by projecting it onto a neighboring surface or wall, or on a fold-out page of the book, or it may become visible by backlighting the holes with an illumination source, like a jack o'lantern. The book may be designed so that multiple pages may be extended simultaneously, with each page contributing a portion of the visible or transparent images. For example, one page may have opaque regions that cover some or all of the transparent portions of a second page, so that the illuminated image will change between both pages illuminated simultaneously, or only the second page by itself. If all or a plurality of such pages are so disposed, the illuminated image may be arranged to incrementally become exposed as the covering pages are sequentially folded down.

The above description and appended drawings show only preferred embodiments of the present invention, and not all of the numerous variations and modifications that will become apparent to one skilled in the art upon reading this description. The design of the graphics and illustrations, the textures and opacities of the visible portions, the shapes and disposition of the cut outs or other transparent or holographic portions, the nature or orientation of the illumination source relative to the exposed page, the thickness and material composition of the individual pages or transparent portions, whether paper, fabric or some other material, whether flexible or rigid, and of arbitrary shape or size are only some of the many variations that may be made without diverging from the scope of this invention. The invention may be practiced by starting for each page with a translucent membrane, and then covering selected areas with fully opaque indicia and the remaining areas with partially opaque and absent indicia. It is also possible to practice the present invention in other contexts than just books, wherever it is desired to have a surface comprising a first opaque image, and a second obscured image which becomes visible upon illumination, and especially when it is desired that the second obscured image has different content than the first image. For example, in stage sets, advertising signs, etc. a second obscured image may become visible by backlighting or frontlighting according to the methods disclosed herein. The images may also be disposed on 3-dimensional structures (not shown), such as lampshades or other objects, providing a variety of visible and illuminated lighting effects. Thus, many variations are possible, so that the present invention should be limited only by the claims appended herewith.

The invention claimed is:

1. A novelty communication object comprising at least one page, said at least one page containing a directly visible image and at least one partially obscured image, distinct in content from said directly visible image, and comprising a plurality of dots which become visible when an additional illumination source is directed toward the page.

2. The novelty communication object of claim 1 wherein said partially obscured image is designed to be visible by projection onto a neighboring surface.

3. The novelty communication object of claim 1 wherein said partially obscured image is designed to be visible by backlighting provided by said additional illumination source.

4. The novelty communication object of claim 1, wherein said object comprises a sign, book, brochure or greeting card.

5. The novelty communication object of claim 1, wherein said page comprises a thin sheet, and said dots comprise a plurality of tiny cutouts in said thin sheet.

6. The novelty communication object of claim 1, wherein said page comprises a thin sheet, and said dots comprise a plurality of tiny partially transparent pigmented regions.

7. The novelty communication object of claim 1, wherein said page comprises a thin sheet, and said dots comprise a plurality of tiny holograms.

8. The novelty communication object of claim 1, wherein said page comprises a thin sheet, and said dots comprise a plurality of tiny reflective elements.

9. The novelty communication object of claim 1, wherein said page comprises a membrane transmissive of light, and an opaque layer having a plurality of tiny voids forming said dots.

10. A novelty book comprising at least one page, said at least one page containing directly visible images presenting narrative content, and at least one partially obscured image, distinct in content from said directly visible images, and comprising a plurality of dots which become visible when an additional illumination source is directed toward the page.

11. The novelty book of claim 10, wherein said partially obscured image is designed to be visible by projection onto a neighboring surface.

12. The novelty book of claim 10, wherein said partially obscured image is designed to be visible by backlighting provided by said additional illumination source.

13. The novelty book of claim 10, wherein said object comprises a sign, book, brochure or greeting card.

14. The novelty book of claim 10, wherein said page comprises a thin sheet, and said dots comprise a plurality of tiny cutouts in said thin sheet.

15. The novelty book of claim 10, wherein said page comprises a thin sheet, and said dots comprise a plurality of tiny partially transparent pigmented regions.

16. The novelty book of claim 10, wherein said page comprises a thin sheet, and said dots comprise a plurality of tiny holograms.

17. The novelty book of claim 10, wherein said page comprises a thin sheet, and said dots comprise a plurality of tiny reflective elements.

18. The novelty book of claim 10, wherein said page comprises a membrane transmissive of light, and an opaque layer having a plurality of tiny voids forming said dots.

19. The method of making a novelty communication object having at least one page, comprising establishing on said page a directly visible image and at least one partially obscured image, distinct in content from said directly visible image, wherein said partially obscured image comprises a plurality of dots which become visible when an additional illumination source is directed toward the page.

20. The method of making a novelty communication object of claim 19, wherein said at least one page comprises a thin sheet, and said step of establishing a plurality of dots comprises producing a plurality of apertures in said sheet.

21. The method of making a novelty communication object of claim 20, wherein said step of producing apertures comprises embossing said sheet.

22. The method of making a novelty communication object of claim 20, wherein said step of producing apertures comprises exposing said sheet to an energy beam.

23. The method of making a novelty communication object of claim 19, wherein said at least one page comprises a translucent sheet which is made fully opaque in selected areas and containing less than fully opaque areas forming said dots.

* * * * *